US011110477B2

(12) United States Patent
Luo

(10) Patent No.: US 11,110,477 B2
(45) Date of Patent: Sep. 7, 2021

(54) SPRINKLER PRESSURE REGULATOR HAVING A FILTER BASKET

(71) Applicant: K-RAIN MANUFACTURING CORP., Riviera Beach, FL (US)

(72) Inventor: Danhui Luo, Lake Worth, FL (US)

(73) Assignee: K-Rain Manufacturing Corp., Riviera Beach, FL (US)

( * ) Notice: Subject to any disclaimer, the term of this patent is extended or adjusted under 35 U.S.C. 154(b) by 234 days.

(21) Appl. No.: 16/402,993

(22) Filed: May 3, 2019

(65) Prior Publication Data

US 2020/0346237 A1 Nov. 5, 2020

(51) Int. Cl.
*B05B 15/40* (2018.01)
*B05B 15/65* (2018.01)
*B05B 15/74* (2018.01)

(52) U.S. Cl.
CPC ..... *B05B 15/40* (2018.02); *B05B 15/65* (2018.02); *B05B 15/74* (2018.02)

(58) Field of Classification Search
CPC ..... B05B 15/40; B05B 15/65; B05B 15/74; B05B 1/3006; B05B 1/323
USPC ..... 239/203–206, 570, 571, 577
See application file for complete search history.

(56) References Cited

U.S. PATENT DOCUMENTS 4,787,558 A * 11/1988 Sexton ..... B05B 3/16 239/205
5,375,768 A * 12/1994 Clark ..... B05B 15/74 239/210
5,676,315 A * 10/1997 Han ..... B05B 3/0431 239/590
6,457,656 B1 * 10/2002 Scott ..... B05B 15/74 239/205
6,491,235 B1 * 12/2002 Scott ..... B05B 1/30 239/206
7,434,747 B2 * 10/2008 Helzer ..... B05B 15/50 239/240
8,430,376 B1 * 4/2013 Danner ..... B05B 1/3033 251/61
2007/0034711 A1 * 2/2007 Kah, Jr. ..... B05B 1/3033 239/205
2020/0346237 A1 * 11/2020 Luo ..... B05B 1/3006

* cited by examiner

*Primary Examiner* — Christopher S Kim
(74) *Attorney, Agent, or Firm* — Amster, Rothstein & Ebenstein LLP

(57) ABSTRACT

A pressure regulator for use in a sprinkler assembly including a riser and a sprinkler basket includes an outer sleeve mounted in the riser at an inlet thereof and a pressure responsive member, movably mounted in the outer sleeve and movable from an open position allowing flow of water between the top surface of the filter basket and the bottom edge of the pressure responsive member and up the riser and a closed position where the bottom edge of the pressure responsive member contacts the top surface of the filter basket to prevent water from flowing. The pressure responsive member is biased in the open position and moves into the closed position when downstream water pressure exceeds a predetermined value.

20 Claims, 10 Drawing Sheets

SPRINKLER PRESSURE REGULATOR HAVING A FILTER BASKET

BACKGROUND

Field of the Disclosure

The present invention relates to a pressure regulator that is integrated with the filter basket of a sprinkler assembly. In particular, the pressure regulator is mounted at an inlet of a riser and includes a movable element that moves based on pressure downstream thereof and cooperates with a valve seat that is formed in a top surface of the filter basket.

Related Art

Pressure regulation is an important consideration in irrigation systems. Variations in pressure in an irrigation system are common and may be localized to particular sprinkler assemblies. These pressure variations may result in excessive water waste.

Accordingly, it would be beneficial to provide a pressure regulator suitable for use in individual sprinkler assemblies to regulate pressure and prevent water waste.

SUMMARY

It is an object of the present application to provide a pressure regulator for use in an individual sprinkler assembly to regulate pressure and prevent waste.

A sprinkler assembly in accordance with an embodiment of the present disclosure includes a base including a water inlet; a riser, in fluid communication with the inlet and movably mounted in the base to move from a retracted position to an extended position when based on water pressure provided by water entering the base through the water inlet; a nozzle housing in fluid communication with the riser and rotatably mounted on a top of the riser; a filter basket mounted on a bottom of the riser; and a pressure regulator mounted at a bottom of the riser and in contact with the filter basket, the pressure regulator including: an outer sleeve mounted on an interior wall of the riser; a pressure responsive member, movably mounted in the outer sleeve and movable from an open position in which a bottom edge of the pressure responsive element is spaced from a top surface of the filter basket to allow flow of water between the top surface of the filter basket and the bottom edge of the pressure responsive member and up the riser and a closed position where the bottom edge of the pressure responsive member contacts the top surface of the filter basket to prevent water from flowing; wherein the pressure responsive member is biased in the open position and moves into the closed position when water pressure downstream of the pressure responsive element exceeds a predetermined value.

A pressure regulator for use in a sprinkler assembly including a riser and a sprinkler basket mounted at a bottom of the riser in accordance with an embodiment of he present disclosure includes: an outer sleeve mounted on an interior wall of the riser at an inlet thereof; a pressure responsive member, movably mounted in the outer sleeve and movable from an open position in which a bottom edge of the pressure responsive element is spaced from a top surface of the filter basket to allow flow of water between the top surface of the filter basket and the bottom edge of the pressure responsive member and up the riser and a closed position where the bottom edge of the pressure responsive member contacts the top surface of the filter basket to prevent water from flowing; wherein the pressure responsive member is biased in the open position and moves into the closed position when water pressure downstream of the pressure responsive element exceeds a predetermined value.

BRIEF DESCRIPTION OF THE DRAWINGS

The above and related objects, features and advantages of the present disclosure will be more fully understood by reference to the following detailed description of the preferred, albeit illustrative, embodiments of the present invention when taken in conjunction with the accompanying figures, wherein.

DETAILED DESCRIPTION OF THE EXEMPLARY EMBODIMENTS

Figure 1:
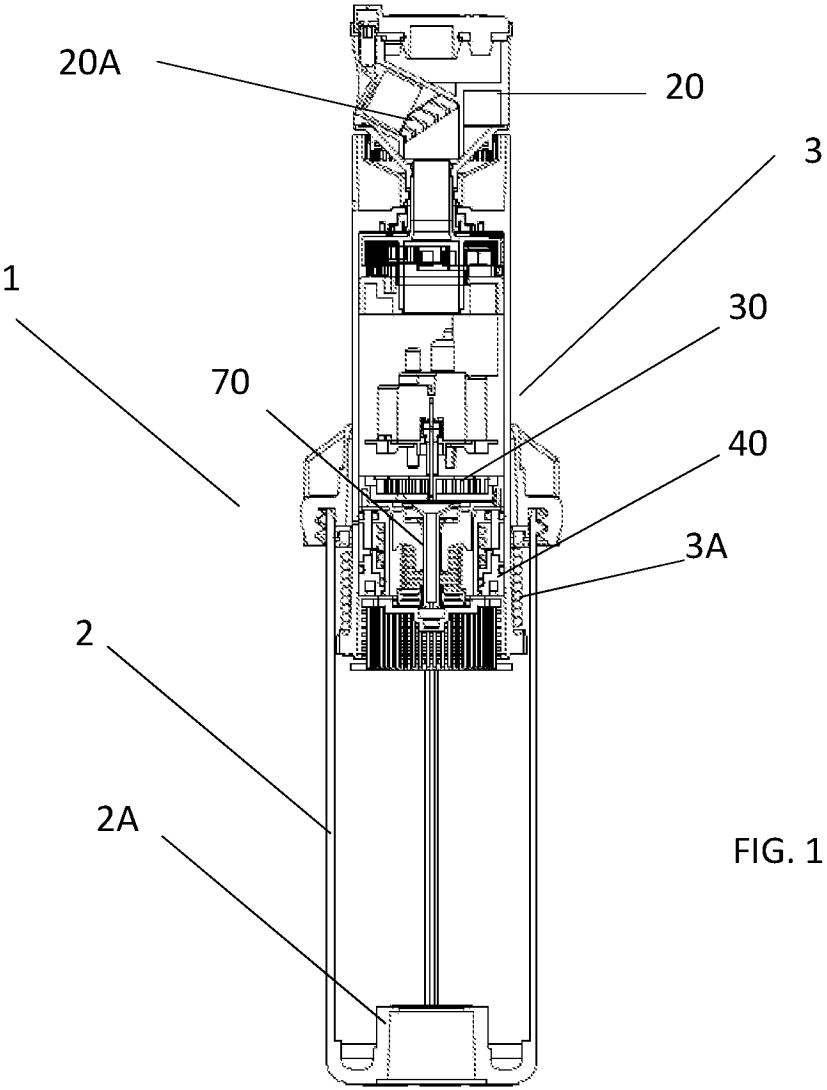
FIG. 1 illustrates an exemplary cross-sectional view of a sprinkler assembly including a pressure regulator in accordance with an embodiment of the present application.
Figure 1B:
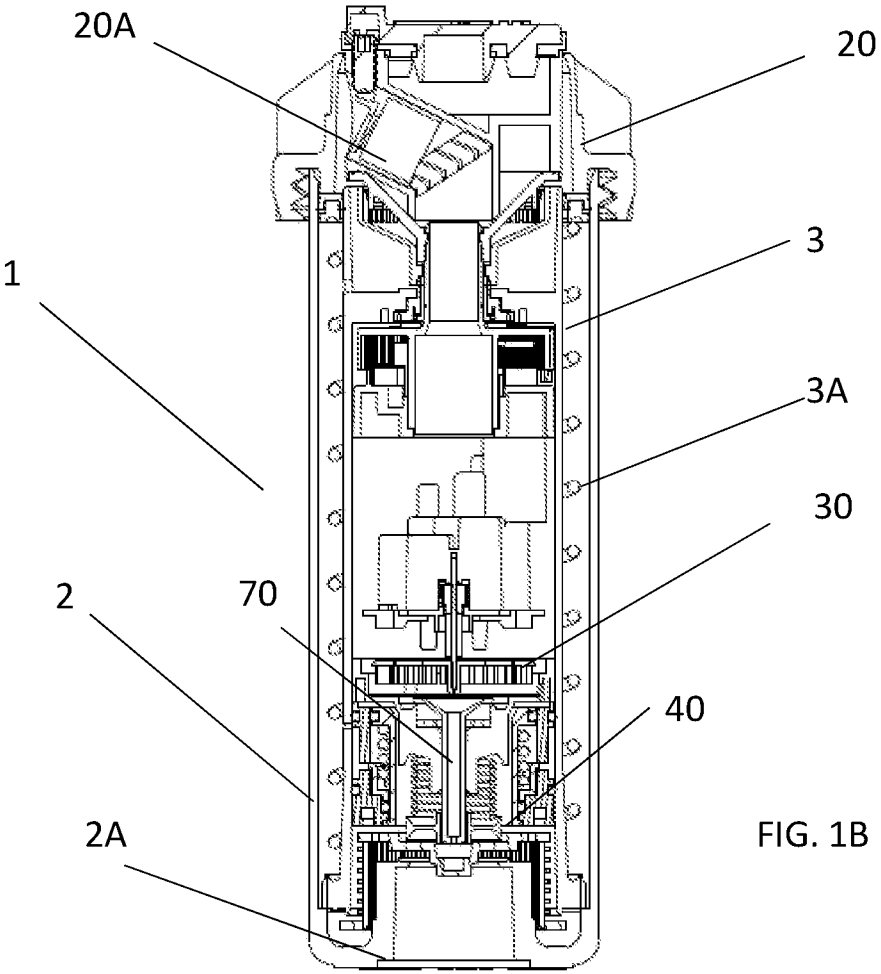
FIG. 1B illustrates an exemplary cross-sectional view of the sprinkler assembly of FIG. 1 with the riser in a retracted position.

FIG. 1 illustrates a cross-sectional view of a sprinkler assembly 1 that includes a pressure regulator 40 in accordance with an embodiment of the present application. In embodiments, the sprinkler assembly 1 may include a base or body 2 in which a riser 3 is movably mounted such that the riser moves into an extended position (see FIG. 1) when acted on by water entering the base 2 via the inlet 2A. In embodiments, water flows into the base 2 and pushes the riser 3 upward into the extended position illustrated in FIG. 1. When water is not flowing through the inlet 2A, the riser spring 3A biases the riser 3 into a retracted position inside of the body 2 as can be seen in FIG. 1B, for example.

In embodiments, a nozzle assembly 20 may be rotatably mounted on a top of the riser 3. In embodiments, the nozzle assembly 20 includes a removable nozzle element 20A that directs water out of the sprinkler assembly 1. In embodiments, the nozzle 20A need not be removable. In embodiments, a turbine 30 may be provided upstream of the nozzle 20A and is operable to rotate the nozzle assembly 20 on top of the riser 3. In embodiments, the flow of water through the turbine 30 drives rotation of the nozzle assembly 20. In embodiments, the rotation of the nozzle assembly 20 may be limited to a preselected arc. Additional details regarding operation of the sprinkler assembly 1, in embodiments, may be found generally in U.S. Pat. No. 8,991,725, which is hereby incorporated by reference herein.

Figure 2:
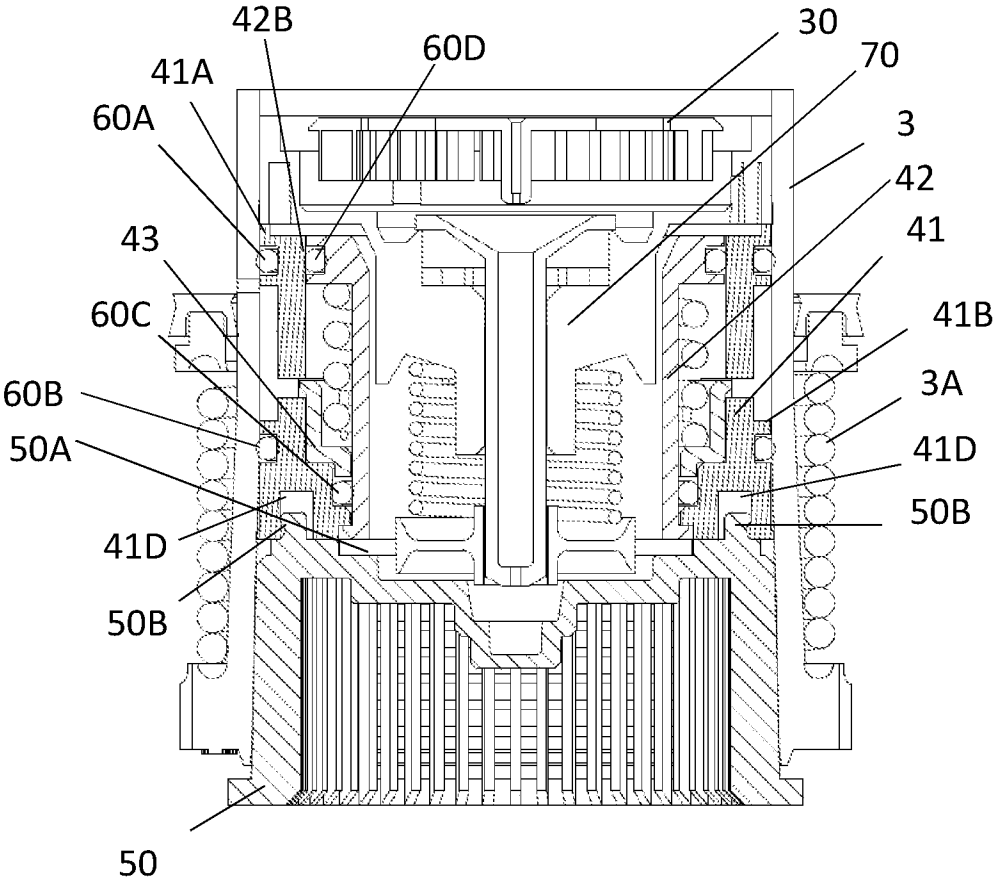
FIG. 2 is a more detailed view of the pressure regulator of FIG. 1 in accordance with an embodiment of the present application.
Figure 3:
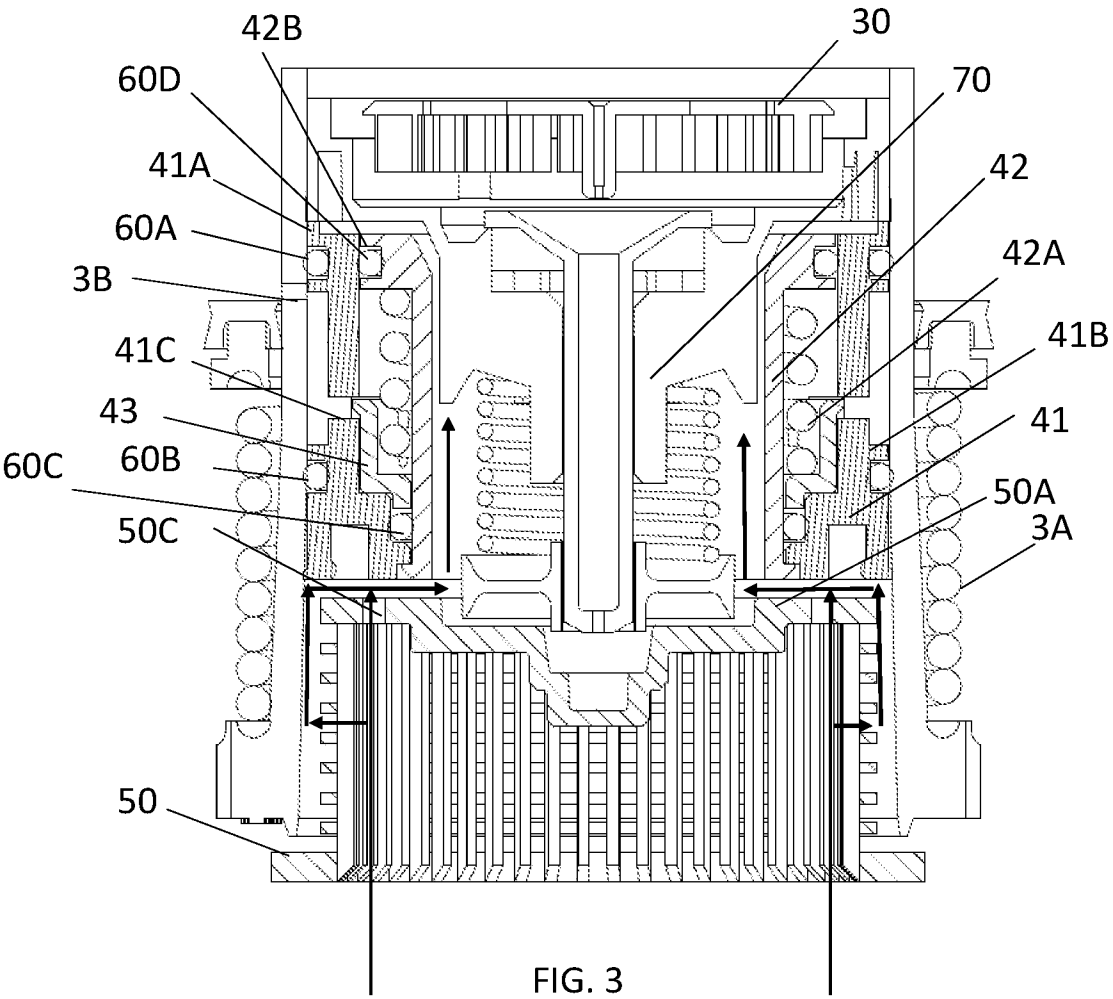
FIG. 3 illustrates a cross-sectional view of the pressure regulator in an open position in accordance with an embodiment of the present application.
Figure 4:
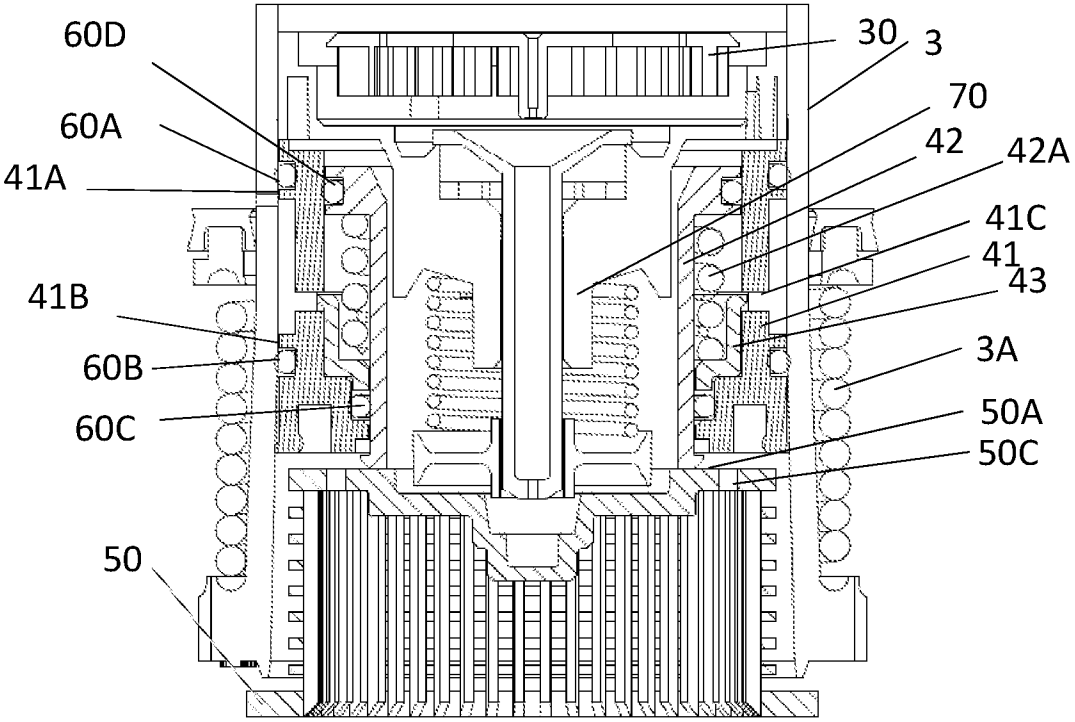
FIG. 4 illustrates a cross-sectional view of the pressure regulator in a closed position in accordance with an embodiment of the present application.
Figure 8:
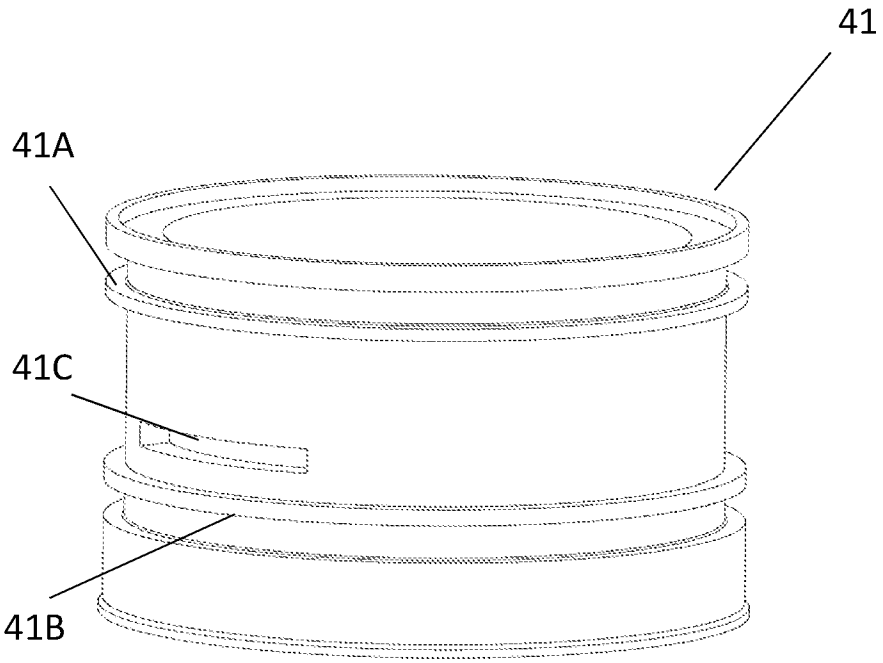
FIG. 8 illustrates a detailed view of a stationary collar used in the pressure regulator in accordance with an embodiment of the present application.

In embodiments, as can be seen in FIGS. 2-4, for example, the pressure regulator 40 may be provided at an inlet of the riser 3, upstream from the turbine 30 and the nozzle assembly 20. In embodiments, the pressure regulator 40 may include a stationary sleeve 41 that is connected to and substantially immovable with respect to an inner surface of the riser 3. In embodiments, the sleeve 41 may be adhered to the inner wall of the riser 3 using an adhesive material or adhesive film. In embodiments, the outer sleeve 41 may be connected to the inner wall of the riser using any suitable fastener. In embodiments, the sleeve 41 may be connected to the inner surface of the riser in any other suitable manner. The sleeve 41 is illustrated in more detail in FIG. 8. In embodiments, the sleeve 41 may include upper and lower channels 41A and 41B that accommodate riser seals 60A, 60B, respectively. The seals 60A, 60B form a seal between the sleeve 41 and the inner wall of the riser to prevent water from passing between them. In embodiments, the riser seals 60A, 60B may be O-rings. In embodiments, the sleeve 41 may also include arcuate slots 41C formed in a sidewall thereof.

Figure 5:
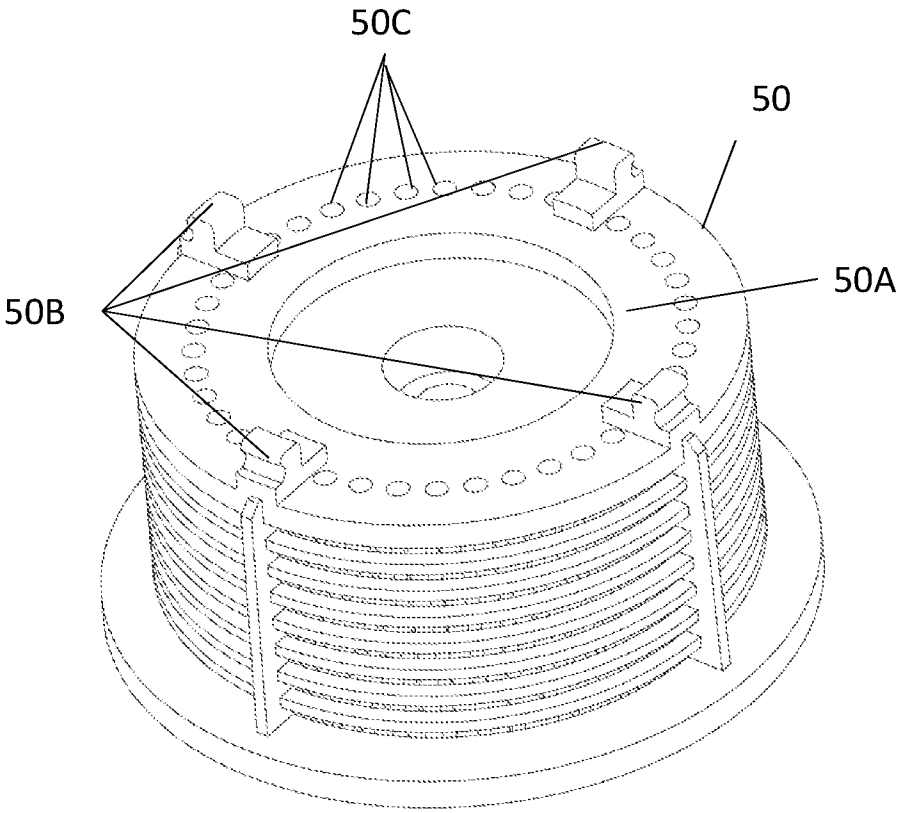
FIG. 5 illustrates a detailed view of a filter basket included in the sprinkler assembly of FIG. 1 in accordance with an embodiment of the present application.
Figure 6:
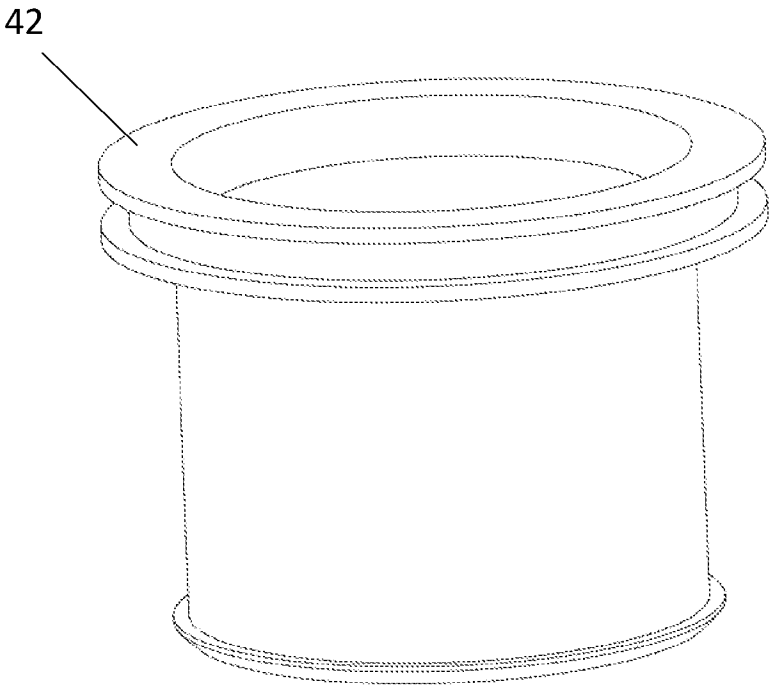
FIG. 6 illustrates a detailed view of a movable member of the pressure regulator in accordance with an embodiment of the present application.
Figure 7:
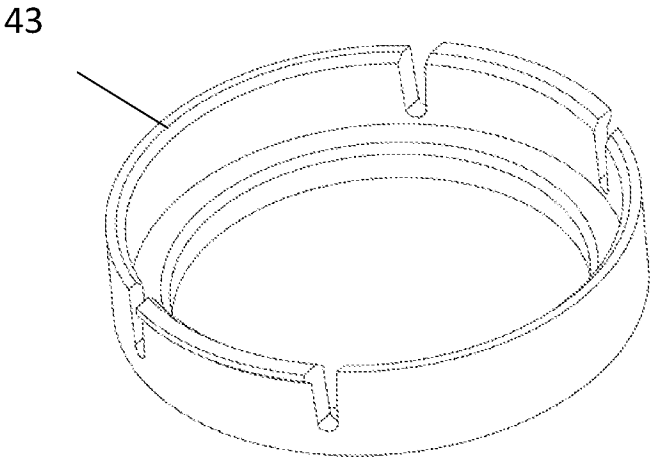
FIG. 7 illustrates a detailed view of a collar used in the pressure regulator in accordance with an embodiment of the present application.

In embodiments, the pressure regulator 40 may also include and cooperate with a top surface 50A of the filter basket 50. In embodiments, the filter basket 50 may be removably secured at a bottom of the riser 3. In embodiments, the filter basket 50 may include hooks or other protrusions 50B that extend upward and may be received in recesses, or other openings 41D, provided in a bottom surface of the sleeve 41. In embodiments, the protrusions 50B removably secure the filter basket 50 to the sleeve 41 and riser 3 (see FIGS. 2 and 5, for example).

In embodiments, a pressure responsive element 42 may be mounted inside the sleeve 41. In embodiments, the pressure responsive element 42 is biased in an open position by the pressure responsive spring 42A to allow the flow of water up and through the turbine 30, as can be seen in FIG. 3, for example. As indicated by the arrows in FIG. 3, water flows through the openings 50C formed in the top surface 50A of the filter basket 50 and up through the turbine 30 in normal operation. As indicated in FIG. 3, water may also flow through the sidewalls of the filter basket 50 and up into the riser 3.

In embodiments, when the pressure downstream of the pressure responsive element 42 is higher than desired, the pressure pushes the pressure responsive element 42 downward and overcomes the bias force provided by the pressure responsive spring 42A to lower the pressure responsive element 42 into a closed position adjacent to the top surface 50A of the filter basket 50 as can be seen in FIG. 4, for example. When the pressure responsive element 42 is lowered in the closed position, water from the openings 50C and any water that flows through the sidewall of filter basket 50 is blocked from continuing to flow up through the turbine 30, which reduces flow and pressure downstream. In embodiments, the pressure responsive spring 42A may be selected in accordance with the maximum pressure that is desired downstream of the pressure responsive member 42. In embodiments, the maximum desired pressure may be between 30 psi and 90 psi, depending on the specific application that the sprinkler assembly is being used in.

In embodiments, a collar 43 may be provided near a bottom of the sleeve 41 to hold lower responsive seal 60C in place. The seal 60C, along with an upper responsive seal 60D prevent leakage between the sleeve 41 and the pressure responsive element 42. In embodiments, the pressure responsive member 42 may include an upper collar 42B that receives the seal 60D. In embodiments, the seals 60C, 60D may be O-rings. In embodiments, the seals 60C, 60D may use any suitable sealing structure.

In embodiments, the riser 3 may include at least one opening 3B formed in a sidewall thereof adjacent to a middle portion of the sleeve 41. In embodiments, the middle portion of the sleeve 41 includes the arcuate slot 41C such that the opening 3B provides a reference pressure on one side of the pressure responsive element 42 relative to the downstream pressure on the opposite side. In embodiments, since the riser 3 will typically be in the raised position when water is flowing, the opening 3B will be outside of the base 2 such that the reference pressure will generally be atmospheric pressure. In embodiments, atmospheric pressure is the preferred reference pressure since the pressure at the exit of the nozzle 20A is also atmospheric pressure.

In embodiments, a bypass valve 70 may be positioned inside, or at least partially within the sleeve 41 in order to maximize the use of space inside the riser 3. In embodiments, the bypass valve 70 will operate independently of the pressure regulator 40. In embodiments, the bypass valve 70 will generally serve to allow for water flow to bypass the turbine 30 when an upstream pressure exceeds a certain value to prevent overspinning of the turbine. Operation of the bypass valve 70 is generally discussed in U.S. Pat. No. 7,416,139, the entire content of which is hereby incorporated by reference herein.

Figure 3B:
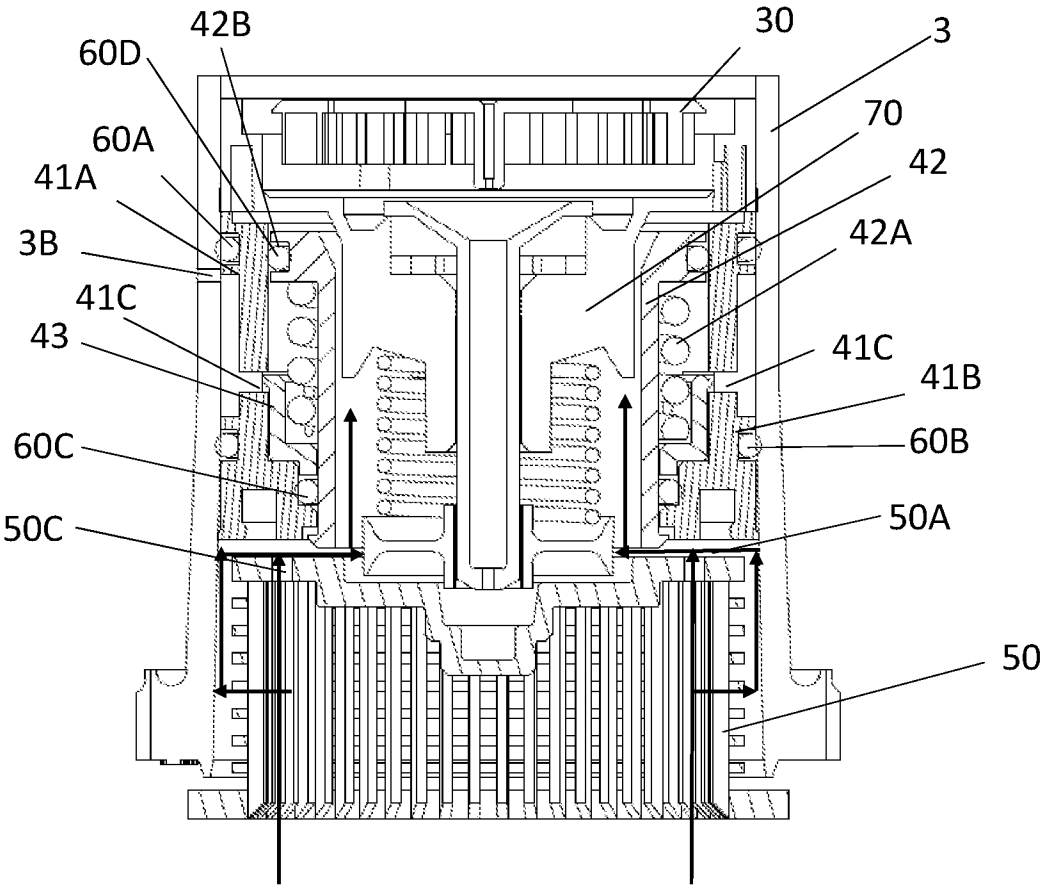
FIG. 3B illustrates a cross-sectional view of the pressure regulator in a partially closed position in accordance with an embodiment of the present application.

In embodiments, the pressure responsive element 42 may move from the fully open position illustrated in FIG. 3 to an intermediate position in which water flow to the turbine 30 is restricted, but may not be totally cut off as can be seen in FIG. 3B for example. In embodiments, where water flow is not completely cut off by the pressure responsive element 42, the reduced flow or water will result in reduction of downstream pressure without total cutoff of flow. Thus, the pressure regulator 40 provides for fine tuning of pressure which would be unavailable if the regulator were limited to only being fully open or fully closed.

Since pressure regulator 40 cooperates with the filter basket 50 and includes the bypass valve 70, it allows for pressure regulation while minimizing the amount of space that it takes up. Accordingly, the pressure regulator 40 may be used in a wide variety of sprinkler assemblies without the need for substantial modifications.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

What is claimed is:

1. A sprinkler assembly comprises:

a base including a water inlet;

a riser, in fluid communication with the inlet and movably mounted in the base to move from a retracted position to an extended position when based on water pressure provided by water entering the base through the water inlet;

a nozzle housing in fluid communication with the riser and rotatably mounted on a top of the riser;

a filter basket mounted on a bottom of the riser; and a pressure regulator mounted at a bottom of the riser and in contact with the filter basket;

the pressure regulator including:

an outer sleeve mounted on an interior wall of the riser;

a pressure responsive member, movably mounted in the outer sleeve and movable from an open position in which a bottom edge of the pressure responsive element is spaced from a top surface of the filter basket to allow flow of water between the top surface of the filter basket and the bottom edge of the pressure responsive member and up the riser and a closed position where the bottom edge of the pressure responsive member contacts the top surface of the filter basket to prevent water from flowing; and a biasing element in contact with the pressure responsive member;

wherein the pressure responsive member is biased in the open position by the biasing element and moves into the closed position when water pressure downstream of the pressure responsive element exceeds a predetermined value.

2. The sprinkler assembly of claim 1, further comprising adhesive mounting the outer sleeve to the interior wall of the riser.

3. The sprinkler assembly of claim 1, wherein the pressure responsive member further comprises:

a first channel formed around a top portion of an outer surface thereof with a first seal element mounted therein; and a second channel formed around a bottom portion of the outer surface thereof with a second seal element mounted therein; wherein the first seal element and the second seal element prevent flow of water between the outer sleeve and the inner wall of the riser.

4. The sprinkler assembly of claim 1, wherein the outer sleeve includes at least one open slot formed in a sidewall thereof.

5. The sprinkler assembly of claim 4, wherein the riser includes at least one opening formed in a sidewall thereof, wherein the at least one open slot is aligned relative to the at least one opening to provide a reference pressure on one side of the pressure responsive element.

6. The sprinkler assembly of claim 5, wherein the at least one opening is positioned in the riser such that the portion of the riser in which the at least one opening is positioned is outside of the base when the riser is in the extended position such that the reference pressure is atmospheric pressure.

7. The sprinkler assembly of claim 1, wherein the filter basket further comprises:

at least one protrusion extending upward from the top surface of the filter basket.

8. The sprinkler assembly of claim 7, wherein the outer sleeve includes at least one recess formed in a bottom surface thereof; wherein the at least one recess is formed to receive the at least one protrusion to secure the filter basket to the outer sleeve.

9. The sprinkler assembly of claim 8, wherein the at least one recess is formed to removably receive the least one protrusion such that the filter basket is removable from the outer sleeve.

10. The sprinkler of claim 1, further comprising a retaining ring in contact with an inner surface of the outer sleeve and an outer surface of the pressure responsive member, wherein the retaining ring holds a lower seal in place near a bottom of an exterior surface of the pressure responsive member, wherein the lower seal prevents water flow between the outer sleeve and the pressure responsive member.

11. The sprinkler of claim 1, wherein the pressure responsive member includes an upper channel positioned near a top thereof and structured to receive an upper seal, wherein the upper seal prevents water flow between the outer sleeve and the pressure responsive member.

12. The sprinkler of claim 1, wherein the biasing element is selected such that a bias force thereof is overcome when the downstream pressure exceeds the predetermined value.

13. The sprinkler assembly of claim 1, wherein the predetermined value is in range of 30 psi to 90 psi.

14. A pressure regulator comprises:

an outer sleeve mounted on an interior wall of a riser of a sprinkler assembly at an inlet thereof;

a pressure responsive member, movably mounted in the outer sleeve and movable from an open position in which a bottom edge of the pressure responsive element is spaced from a top surface of a filter basket mounted at a bottom of the riser to allow flow of water between the top surface of the filter basket and the bottom edge of the pressure responsive member and up the riser, and a closed position where the bottom edge of the pressure responsive member contacts the top surface of the filter basket to prevent water from flowing; and a biasing element in contact with the pressure responsive element;

wherein the pressure responsive member is biased in the open position by the biasing element and moves into the closed position when water pressure downstream of the pressure responsive element exceeds a predetermined value.

15. The pressure regulator of claim 14, further comprising adhesive mounting the outer sleeve to an interior wall of the riser.

16. The pressure regulator of claim 14, wherein the pressure responsive member further comprises:

a first groove formed around a top portion of an outer surface thereof with a first seal element mounted therein; and a second collar formed around a bottom portion of the outer surface thereof with a second seal element mounted therein; wherein the first seal element and the second deal element prevent flow of water between the outer sleeve and an inner wall of the riser.

17. The pressure regulator of claim 14, wherein the outer sleeve includes at least one slot formed in a sidewall thereof, wherein the at least one slot is positioned to align with at least one opening provided in a sidewall of the riser to provide a reference pressure on a bottom side of the pressure responsive member.

18. The sprinkler assembly of claim 14, wherein the filter basket includes at least one protrusion extending upward from the top surface of the filter basket; and the outer sleeve includes at least one recess formed in a bottom surface thereof; wherein the at least one recess is formed to receive the at least one protrusion to secure the filter basket to the outer sleeve.

19. The sprinkler of claim 14, further comprising:

a retaining ring in contact with an inner surface of the outer sleeve and an outer surface of the pressure responsive member, wherein the retaining ring holds a lower seal in place near a bottom of the pressure responsive member; and the pressure responsive member includes:

an upper channel position near a top thereof and structure to receive an upper seal, wherein the upper seal prevents water flow between the outer sleeve and the pressure responsive member;

wherein the lower seal and the upper seal prevent flow of water between the pressure responsive member and the outer sleeve.

20. The sprinkler of claim 14, wherein the biasing element is selected such that the bias force thereof is overcome when the downstream pressure exceeds the predetermine value, and the predetermined value is in range of 30 psi to 90 psi.

* * * * *